US009669641B2

(12) United States Patent
Holtman et al.

(10) Patent No.: US 9,669,641 B2
(45) Date of Patent: Jun. 6, 2017

(54) VACUUM PLATEN

(71) Applicant: OCÉ-TECHNOLOGIES B.V., Venlo (NL)

(72) Inventors: Lodewijk T. Holtman, Venlo (NL); Alphonse L. J. M. Van Der Mullen, Venlo (NL)

(73) Assignee: OCÉ-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 14/937,657

(22) Filed: Nov. 10, 2015

(65) Prior Publication Data

US 2016/0129705 A1 May 12, 2016

(30) Foreign Application Priority Data

Nov. 11, 2014 (EP) ..... 14192680

(51) Int. Cl.
*B41J 11/00* (2006.01)
*B41J 11/06* (2006.01)

(52) U.S. Cl.
CPC ..... *B41J 11/0085* (2013.01); *B41J 11/06* (2013.01)

(58) Field of Classification Search
CPC ..... B41J 11/0085; B41J 11/06
See application file for complete search history.

(56) References Cited

U.S. PATENT DOCUMENTS 6,254,092 B1 * 7/2001 Yraceburu ..... B41J 11/007 271/197
6,328,491 B1 * 12/2001 Beehler ..... B41J 2/185 347/35
6,572,294 B2 * 6/2003 Beehler ..... B41J 2/185 347/34
7,765,927 B1 * 8/2010 Liu ..... B41F 15/0895 101/126
2001/0020959 A1 9/2001 Van Soest et al.
2002/0071016 A1 * 6/2002 Wotton ..... B41J 11/002 347/102
2002/0097311 A1 * 7/2002 Hinojosa ..... B41J 11/0025 347/104
2009/0251522 A1 * 10/2009 Koike ..... B41J 11/002 347/104
2010/0271425 A1 * 10/2010 Bober ..... B41J 11/007 347/34

(Continued)

FOREIGN PATENT DOCUMENTS

DE 199 29 319 A1 12/2000
EP 1 182 040 B1 11/2005
GB 2359520 A * 8/2001 ..... B41J 11/007

(Continued)

*Primary Examiner* — Marc Carlson
(74) *Attorney, Agent, or Firm* — Birch, Stewart, Kolasch & Birch, LLP

(57) ABSTRACT

A vacuum platen for media sheets has a sheet support wall formed with a plurality of perforations and a number of chambers formed on a bottom side of the sheet support wall. Each of the chambers is directly connected to a vacuum source. Each chamber contains an acoustic barrier member arranged to divide the chamber into at least two sub-chambers such that the sub-chambers are in fluid communication with one another and have overlapping contours when seen in a direction normal to the plane of the sheet support wall.

12 Claims, 1 Drawing Sheet

(56) References Cited

U.S. PATENT DOCUMENTS

2015/0225943 A1* 8/2015 Oppenheimer ..... B41J 29/08
347/108

FOREIGN PATENT DOCUMENTS

| | | | | |
|---|---|---|---|---|
| JP | 2001-171188 | A | | 6/2001 |
| JP | 2009-067015 | A | | 4/2009 |
| JP | 2009067015 | A | * | 4/2009 |

* cited by examiner

VACUUM PLATEN

CROSS-REFERENCE TO RELATED APPLICATIONS

This application claims priority under 35 U.S.C. §119(a) to Application No. 14192680.8 filed in Europe on Nov. 11, 2014, the entire contents of which is hereby incorporated by reference into the present application.

BACKGROUND OF THE PRESENT INVENTION

1. Field of the Invention

The present invention relates to a vacuum platen for media sheets, having a sheet support wall formed with a plurality of perforations, and a number of chambers formed on a bottom side of the sheet support wall, wherein each of said chambers is directly connected to a vacuum source.

2. Description of Background Art

An example of a vacuum platen of this type is described in EP 1 182 040 B1.

Such vacuum platens are used, for example, in printers or copiers for holding media sheets in a flat condition on the surface of the platen. Since a vacuum is created in each of the chambers by a vacuum source or sources, ambient air will be drawn-in through the perforations of the sheet support wall, so that a sheet that has been placed onto the platen will be attracted against the sheet support wall. In general, it is desired that the platen is capable of holding media sheets of different formats. Thus, when a small format sheet is disposed on the platen, not all of the perforations of the sheet support wall will be covered by the sheet, but a relatively large number of perforations will be left open, e.g. at the lateral sides of the platen. Since a relatively large amount of air will be drawn-in through these open perforations, the vacuum underneath the sheet support plate is likely to break down when the power of the vacuum source is not sufficient. This effect is mitigated by dividing the space below the sheet support wall into the plurality of chambers that are individually connected to the vacuum source, so that it is easier to maintain the vacuum in those chambers for which most of the perforations are covered by the sheet.

Another measure to limit the necessary power of the vacuum source and, accordingly, to limit the energy consumption, is to reduce the size of the perforations, so that less air will be drawn in even when the perforations are open. However, with decreasing size of the perforations, there is an increased risk that the air flow through the perforations causes a disagreeable whistling noise.

It has been attempted to avoid this noise by appropriately selecting the shapes of the perforations and/or by carefully machining the edges of the perforations. These measures, however, increase the production costs and conflict with the objective to reduce the size of the perforations.

SUMMARY OF THE INVENTION

It is an object of the present invention to provide a low-noise vacuum platen without increasing manufacturing costs and/or energy consumption.

According to an embodiment of the present invention, this object is achieved by a vacuum platen of the type indicated above, wherein each chamber contains an acoustic barrier member arranged to divide the chamber into at least two sub-chambers such that the sub-chambers are in fluid communication with one another and have overlapping contours when viewed in a direction normal to the plane of the sheet support wall.

The acoustic barrier member divides the resonance space formed by each of the chambers into smaller spaces which, in particular, have a reduced length in a direction normal to the plane of the sheet support wall, which tends to prevent resonance oscillations from being excited in the air column between the sheet support wall and an opposing bottom wall of the chamber. It has been found that this simple measure can efficiently suppress the generation of whistling noises. On the other hand, since the sub-chambers of each chamber are still in fluid communication with one another, the effective cross-section of each chamber is not reduced, so that the flow of air from the perforations towards the point where the chamber is connected to the vacuum source will not be restricted.

More specific optional features of the present invention are indicated in the dependent claims.

In a preferred embodiment of the present invention, the chambers at the bottom side of the sheet support wall are configured as parallel channels, which have a substantially rectangular cross-section, and the acoustic barrier member is formed by a flat strip of material, e.g. plastic, that extends along a diagonal of the rectangular cross-section. Then, each chamber will be divided into two sub-chambers, each of which has a triangular cross-section. This not only permits to easily fix the acoustic barrier member within the channel, but also has the advantage that the height of each sub-chamber as measured in the direction normal to the sheet support wall will vary over the width of the chamber, with the result, that the resonance space for the air column will not define a unique resonance frequency but a relatively broad frequency spectrum, which makes the occurrence of resonance oscillations less likely.

In an embodiment of the present invention, the sub-chambers are overlapping when seen in the direction normal to the plane of the sheet support wall. The acoustic barrier member may be formed by a sheet or strip, which barrier member extends diagonally, at an incline, or at an angle to the direction normal to the plane of the sheet support wall. The angle may preferably be any angle that is not parallel to the direction normal to the plane of the sheet support wall.

Further scope of applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
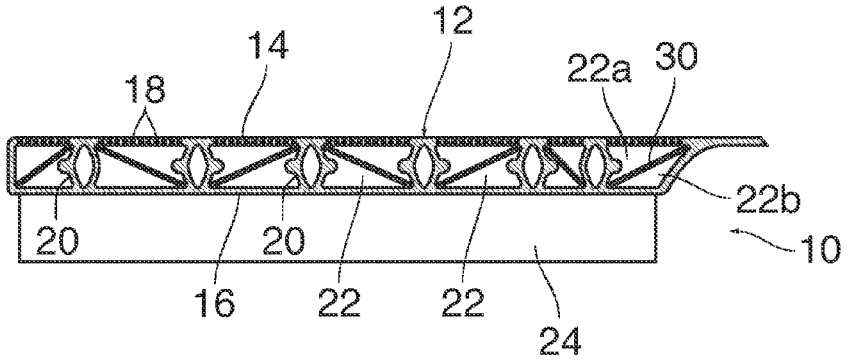
FIG. 1 is a cross-sectional view of a vacuum platen according to an embodiment of the present invention.

The present invention will now be described with reference to the accompanying drawings, wherein the same reference numerals have been used to identify the same or similar elements throughout the several views.

As is shown in FIG. 1, a vacuum platen 10 is mainly formed by an extruded hollow profile member 12 that is made of metal and forms a sheet support wall 14 on the top side and a bottom wall 16 on the bottom side. A plurality of fine perforations 18 are formed in the sheet support wall 14.

The profile member 12 further forms a number of cooling channels 20 that extend in parallel to one another in a width-wise direction of the platen 10 and divide the space between the sheet support wall 14 and the bottom wall 16 into a plurality of chambers 22. The chambers 22 are formed directly on a bottom side of the sheet support wall 14. As can be seen in FIG. 1, the chambers 22 are defined or limited by the sheet support wall 14 and the bottom wall 16 to form a top wall and a bottom wall of the chambers 22. Further wall elements, comprising the cooling channels 20, extend between and connect the sheet support wall 14 and the bottom wall 16 to form a front wall of one chamber 22 and a rear wall of an adjacent chamber 22.

A vacuum source 24 is arranged below the profile member 12. As has been shown in FIG. 2, the vacuum source 24 is arranged in the width-wise center of the platen 10 and is directly connected to each of the chambers 22 via at least one opening 26 in the bottom wall 16.

As is well known in the art, the vacuum source 24 may comprise a blower and a manifold that connects the blower to each of the openings 26.

Figure 2:
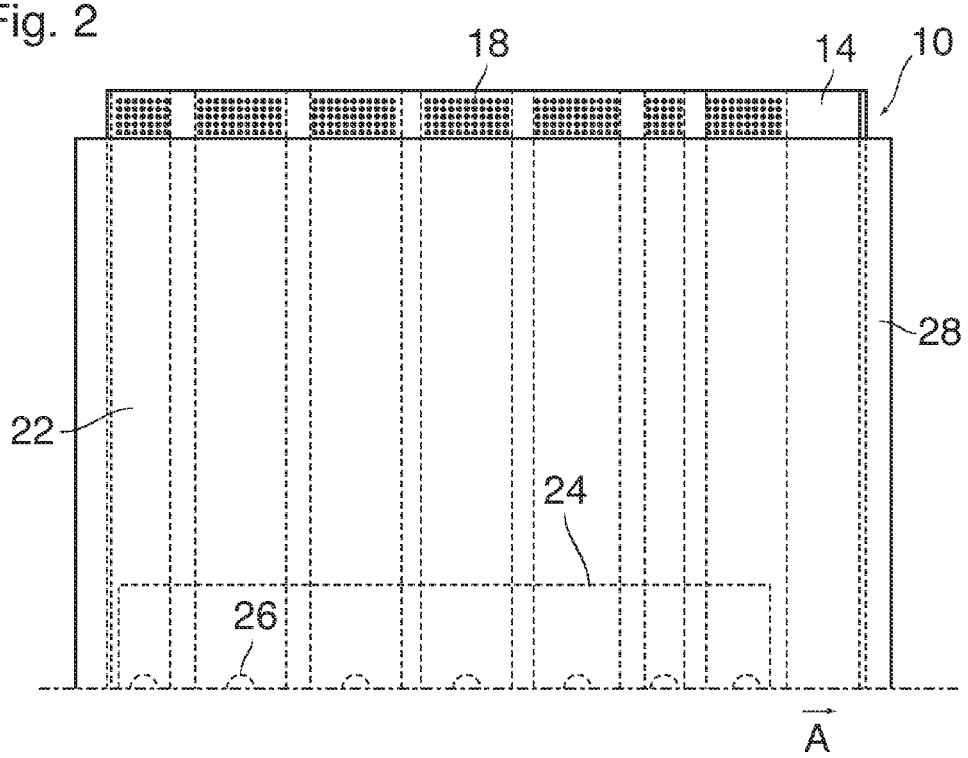
FIG. 2 is a schematic top plan view of one half of the vacuum platen with a media sheet disposed thereon.

The vacuum source 24 creates a vacuum in each of the chambers 22, so that ambient air will be drawn-in through the perforations 18. As a result, when a media sheet 28 is present on the sheet support wall 14, as shown in FIG. 2, the sheet will cover most of the perforations 18, so that the air flows are blocked and the sheet is attracted against the top surface of the sheet support wall 14. This will assure that the sheet 28 is reliably held in a flat condition in which it may be processed in a printer, e.g. in an ink jet printer where an ink jet print head moves across the platen 10.

In the example shown, the platen 10 is used mainly for cooling the sheets 28 that have been heated in the course of the print process. To that end, a cooling medium, e.g. water, is circulated through the cooling channels 20 of the profile member 12, so that the sheet 28 that is sucked against the platen will be cooled by thermal contact with the sheet support wall 14, and the heat will be carried away by the cooling medium.

As has been shown in FIG. 2, depending upon the width of the sheet 28, a number of perforations 18 in the marginal regions of the sheet support wall 14 will be left open, and a relatively large amount of air will enter into the chambers 22 through these non-obstructed perforations. Consequently, the vacuum source 24 must be powerful enough to maintain the vacuum in spite of this inflow of air.

Moreover, when the sheet 28 is moved over the platen (by means of a conveying mechanism that has not been shown here), e.g. in the direction of an arrow A in FIG. 2, the trailing edge of the sheet will expose all the perforations 18 of the leftmost chamber 22 in FIG. 2, causing a breakdown of the vacuum in that chamber. However, since the parallel, channel-like chambers 22 are separated from one another by the cooling channels 20, the breakdown of the vacuum will mainly be limited to the chamber that is directly affected, and the vacuum in the other chambers will still be maintained because these chambers are directly connected to the vacuum source via the openings 26.

Figure 3:
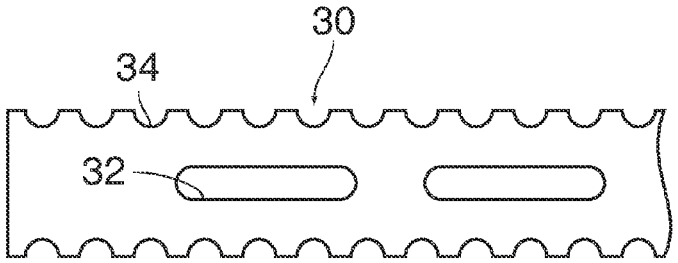
FIG. 3 is a plan view of an acoustic barrier member.

As has been shown in FIG. 1, the chambers 22 have an essentially rectangular cross-section, and a strip-like acoustic barrier member 30 has been inserted into each of the chambers 22 so as to extend along a diagonal of the rectangular cross-section, thereby dividing each chamber into sub-chambers 22*a*, 22*b* that have essentially triangular cross-sections and overlap or are actually superposed one upon the other in the direction normal to the plane of the sheet support wall 14. Each of the acoustic barrier members 30 may be formed by a flat strip of plastic material, a portion of which has been shown in FIG. 3 in a plan view. It can be seen that elongated holes 32 are internally formed through an intermediate portion of the barrier 30, and the longitudinal edges thereof have recesses 34 formed therein, so that the two sub-chambers 22*a* and 22*b* that are separated by the barrier 30 are still in fluid communication with each other via holes 32 and recesses 34. Consequently, the entire cross-section of the chamber 22 is available for the flow of air from the outer ends of each chamber towards the opening 26 in the central portion. The sub-chamber 22*a* is defined by the sheet support wall 14, the acoustic barrier member 30, and a further wall element, comprising the cooling channels 20. The sub-chamber 22*b* is defined by the bottom wall 16, the acoustic barrier member 30, and a further wall element, comprising the cooling channels 20. As such, a side wall of the sub-chamber 22*a* is formed by the sheet support wall 14, while a side wall of the sub-chamber 22*b* is formed by the bottom wall 16. It will be appreciated that the further wall element may be any type of wall element and need not comprise the cooling channels 20.

The purpose of the barriers 30 is to avoid the generation of a whistling noise, which might otherwise occur when the air flows with relatively high velocity through the narrow perforations 18. For cost reasons, the perforations 18 are preferably formed by drilling circular holes into the wall 14, and the diameter of these holes may be as small as 1.5 mm or less, in order to avoid the ingress of too much air into the chambers 22. When the air passes through these narrow holes, the edges of the holes, especially when they are not deburred, may cause the air to swirl, with the result that resonance oscillations are excited in the air column between the top wall 14 and the bottom wall 16 of the chamber 22, which then serves as a resonance space. Without the barrier 30, the resonance space would have a uniform length (distance between the walls 14 and 16) on the entire width of the channel, promoting the excitation of acoustic standing waves with a corresponding basic frequency and its higher harmonics. Thanks to the barrier 30, however, the length of the air column is reduced to one half, on the average, which raises the resonance frequency into a domain where oscillations are less likely to be excited by the air swirls. Moreover, the inclination of the barrier 30 has the consequence that the length of the air column varies over the width of the chamber, so that the corresponding wavelengths and resonance frequencies are distributed over a wider range, which significantly reduces the likelihood that resonance oscillations are excited and, if they should be excited nevertheless, reduces their intensity. If the air flow should nevertheless produce any noise, the acoustic spectrum will be more similar to white noise rather than to the disagreeable spectrum of a whistle.

Although specific embodiments of the invention are illustrated and described herein, it will be appreciated by those of ordinary skill in the art that a variety of alternate and/or equivalent implementations exist. It should be appreciated that the exemplary embodiment or exemplary embodiments are examples only and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents. Generally, this application is intended to cover any adaptations or variations of the specific embodiments discussed herein.

It will also be appreciated that in this document the terms "comprise", "comprising", "include", "including", "contain", "containing", "have", "having", and any variations thereof, are intended to be understood in an inclusive (i.e. non-exclusive) sense, such that the process, method, device, apparatus or system described herein is not limited to those features or parts or elements or steps recited, but may include other elements, features, parts or steps not expressly listed or inherent to such process, method, article, or apparatus. Furthermore, the terms "a" and "an" used herein are intended to be understood as meaning one or more unless explicitly stated otherwise. Moreover, the terms "first", "second", "third", etc. are used merely as labels, and are not intended to impose numerical requirements on or to establish a certain ranking of importance of their objects.

The present invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A vacuum platen for media sheets, said vacuum platen comprising:

a sheet support wall formed with a plurality of perforations and a sheet supporting surface; and a number of chambers formed on a bottom side of the sheet support wall, wherein each of said number of chambers is to in fluid communication with a vacuum source and the plurality of perforations, wherein each of said number of chambers contains an acoustic barrier member arranged to divide the chamber into at least two sub-chambers such that the at least two sub-chambers are in fluid communication with one another, and wherein the acoustic barrier member extends at an acute angle to a direction normal to the sheet supporting surface of the sheet support wall, such that a height of each sub-chamber, as measured in the direction normal to the sheet support wall, varies over a width direction of the chamber to reduce acoustic resonance oscillations from being excited in the at least two sub-chambers during operation.

2. The vacuum platen according to claim 1, wherein the acoustic barrier member is a strip member having internal holes formed through an intermediate portion thereof and/or recesses formed in at least one edge thereof, for establishing the fluid communication between the at least two sub-chambers.

3. The vacuum platen according to claim 1, wherein the acoustic barrier member is made of plastic.

4. The vacuum platen according to claim 1, wherein the at least two sub-chambers have overlapping contours when viewed in a direction both parallel to the sheet supporting surface of the sheet support wall and to the width direction of the chamber.

5. The vacuum platen according to claim 1, wherein the number of chambers are parallel channels extending along the bottom side of the sheet support wall.

6. The vacuum platen according to claim 5, wherein when viewed in a direction both parallel to the sheet supporting surface of the sheet support wall and perpendicular to the width direction of each the chamber, each of the parallel channels have a cross-section with at least four sides.

7. The vacuum platen according to claim 6, wherein the acoustic barrier member is a flat strip member inserted into each of the parallel channels, so as to extend along a diagonal of the cross-section.

8. The vacuum platen according to claim 6, wherein the sheet support wall, a bottom wall and the chambers formed between the sheet support wall and the bottom wall are constituted by an extruded profile member.

9. The vacuum platen according to claim 8, wherein the number of chambers are separated from one another by cooling channels that are adapted to circulate a cooling medium through the profile member.

10. The vacuum platen according to claim 6, wherein each of the sub-chambers has a triangular cross-section.

11. The vacuum platen according to claim 1, wherein the perforations in the sheet support wall extend directly into the chambers.

12. The vacuum platen according to claim 1, have overlapping contours when viewed in a direction normal to the sheet supporting surface of the sheet support wall.

* * * * *